US007443262B2

(12) United States Patent
Hasegawa et al.

(10) Patent No.: US 7,443,262 B2
(45) Date of Patent: Oct. 28, 2008

(54) TWO-PORT ISOLATOR, CHARACTERISTIC ADJUSTING METHOD THEREFOR, AND COMMUNICATION APPARATUS

(75) Inventors: Takashi Hasegawa, Mattou (JP); Masakatsu Mori, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/050,365

(22) Filed: Mar. 18, 2008

(65) Prior Publication Data

US 2008/0174381 A1 Jul. 24, 2008

Related U.S. Application Data

(62) Division of application No. 10/909,605, filed on Aug. 2, 2004, now abandoned.

(30) Foreign Application Priority Data

Sep. 4, 2003 (JP) ..... 2003-312689
Jun. 16, 2004 (JP) ..... 2004-178057

(51) Int. Cl.
*H01P 1/36* (2006.01)

(52) U.S. Cl. ..... 333/24.2; 333/1.1

(58) Field of Classification Search ..... 333/1.1, 333/24.2
See application file for complete search history.

(56) References Cited

OTHER PUBLICATIONS

Hasegawa et al.; "Two-Port Isolator, Characteristic Adjusting Method Therefor, and Communication Apparatus"; U.S. Appl. No. 10/909,605, filed Aug. 2, 2004.

*Primary Examiner*—Stephen E Jones
(74) *Attorney, Agent, or Firm*—Keating & Bennett, LLP

(57) ABSTRACT

A two-port isolator includes a metal case having an upper metal case portion and a lower metal case portion, a resin case integrated with the case, a permanent magnet member, a center electrode assembly including a ferrite member and center electrodes, and a laminated base. The intersection angle between the first and second center electrodes is adjusted to be different from about 90 degrees. The input admittance of an input port has a complex conjugate relationship with an external circuit. The intersection angle represents an angle at which the center lines of the outermost widths of the center electrodes intersect with each other. In other words, the intersection angle represents an angle of an end of the first center electrode with respect to the input port and an angle of an end of the second center electrode with respect to a ground port.

10 Claims, 21 Drawing Sheets

TWO-PORT ISOLATOR, CHARACTERISTIC ADJUSTING METHOD THEREFOR, AND COMMUNICATION APPARATUS

BACKGROUND OF THE INVENTION

1. Field of the Invention

The present invention relates to two-port isolators, and in particular, to a two-port isolator for use in microwave bands, a characteristic adjusting method therefor, and a communication apparatus including a two-port isolator.

2. Description of the Related Art

In general, two-port isolators allow signals to pass through them only in a transmitting direction and prevent the signals from passing through them in a reverse direction. The two-port isolators are used in transmitting circuit portions of mobile communication apparatuses, such as automobile telephones and cellular phones.

The isolator disclosed in Japanese Unexamined Patent Application Publication No. 2003-46307 is a known two-port isolator of the type described above, that is, a type of isolator including first and second center electrodes. FIG. 20 shows a two-port isolator 300 as disclosed in the above publication. The two-port isolator 300 includes a ferrite member 303, two center electrodes 301 and 302 which are disposed on an upper surface of the ferrite member 303 and which have an intersection angle Φ between 40 and 80 degrees, matching capacitors C11 and C12, a parallel capacitor Cw, and a resistor R. An inductor L1 defined by the first center electrode 301, and the matching capacitor C11 define a parallel resonant circuit. An inductor L2 defined by the second center electrode 302, and the matching capacitor C12 define a parallel resonant circuit. The two-port isolator 300 also includes an input terminal 311, an output terminal 312, and a ground terminal 313.

The two-port isolator 300 has an advantage in that a high attenuation is obtained even outside an operating frequency range because the first and second center electrodes 301 and 302 are perpendicular to each other. In the two-port isolator 300, one end of the first center electrode 301 is used as an input port P1, one end of the second center electrode 302 is used as an output port P2, and the other ends (common end) of the first and second center electrodes 301 and 302 are used as a ground port P3. The two-port isolator 300 has a problem in that, when a signal is conveyed from the input terminal 311 to the output terminal 312, the two resonant circuits resonate to produce a large insertion loss.

Accordingly, to eliminate this problem, a low-loss two-port isolator is disclosed in Japanese Unexamined Patent Application Publication No. 9-232818. As FIG. 21 shows, a two-port isolator 320 of this type includes a ferrite member 323, two center electrodes 321 and 322 which are disposed on an upper surface of the ferrite member 323 and which have an intersection angle θ of about 90 degrees, matching capacitors C11 and C12, and a resistor R. An inductor L1 defined by the center electrode 321, and the matching capacitor C11 define a parallel resonant circuit. An inductor L2 defined by the center electrode 322, and the matching capacitor C12 define a parallel resonant circuit. The two-port isolator 320 also includes an input terminal 331, an output terminal 332, and a ground terminal 333.

In the two-port isolator 320, one end of the first center electrode 321 is used as an input port P1, one end of the second center electrode 322 is used as a ground port P3, and the other ends of the first and second center electrodes 321 and 322 are used as an output port P2. In the two-port isolator 320, when a signal is conveyed from the input terminal 331 to the output terminal 332, a resonant circuit (defined by the inductor L1 and the matching capacitor C11) between the input port P1 and the output port P2 does not resonate. Only one resonant circuit (defined by an inductor L2 and matching capacitor C12 connected between the output port P2 and the ground port P3) resonates. Thus, in the two-port isolator 320, an insertion loss is reduced.

In general, an input admittance Y12 of a two-port isolator is normally designed to be 0.02 S+0 j S, and its susceptance part is 0 S. In terms of impedance, an input impedance Z12 of the two-port isolator is normally designed to be 50Ω+0 jΩ. However, in the case of mounting the two-port isolator on an actual circuit board of a mobile communication apparatus, the two-port isolator is affected by a pad capacitor on a surface on which the two-port isolator is mounted, lines connected to other components, circuit elements, etc. Accordingly, in relation to an input terminal of the two-port isolator, the susceptance part of the admittance Y11 is not always 0 S. In many cases, it has a positive value (capacitive) or a negative value (inductive).

In addition, in order to enable maximum power to pass in the two-port isolator by reducing a power loss at an input terminal of the isolator, the input admittance Y12 must be matched so as to be a complex conjugate of the admittance Y11. In other words, the susceptance part of the admittance Y12 must be inductive or capacitive in accordance with the susceptance part of the admittance Y11.

In the two-port isolator 300 shown in FIG. 20, the matching capacitor C11 is connected in parallel with the center electrode 301 between the input terminal 311 and the ground. Therefore, by adjusting the capacitance of the matching capacitor C11, the admittance Y12 is easily matched so as to be a complex conjugate of the admittance Y11.

Conversely, in the two-port isolator 320 shown in FIG. 21, no matching capacitor is connected in parallel with the center electrode 321 between the input terminal 331 and the ground. Accordingly, adjustment as in the above two-port isolator 300 is impossible. A matching capacitor could be connected to the input terminal in parallel with the center electrode 321. However, an increase in the number of circuit elements prevents reduction in size and cost. In addition, an increase in the number of connecting points between circuit elements reduces reliability.

SUMMARY OF THE INVENTION

To overcome the above-described problems, preferred embodiments of the present invention provide a two-port isolator in which matching of the admittance of a first input/output port is adjusted, a characteristic adjusting method therefor, and a communication apparatus including the two-port isolator.

According to a preferred embodiment of the present invention, a two-port isolator includes a permanent magnet, a ferrite member to which a direct-current magnetic field is applied by the permanent magnet, a first center electrode having one end electrically connected to a first input/output port and the other end electrically connected to a second input/output port, the first center electrode being provided on the ferrite member, a second center electrode having one end electrically connected to the second input/output port and the other end electrically connected to a ground port, the second center electrode being arranged on the ferrite member so as to intersect with the first center electrode, with the first center electrode and the second center electrode being electrically insulated from each other, a first matching capacitor electrically connected between the first input/output port and the second input/output port, a resistor electrically connected between the first input/output port and the second input/output port, a second matching capacitor electrically connected between the second input/output port and the ground port, a first input/output terminal electrically connected to the first input/output port, and a second input/output terminal electrically connected to the second input/output port. One of the first input/output port and the second input/output port defines an input port, and the other one defines an output port, and the intersection angle between the first center electrode and the second center electrode is adjusted to be less than about 90 degrees, and the susceptance part of the admittance of the first input/output port is negative in the pass-band center frequency.

According to another preferred embodiment of the present invention, a two-port isolator includes a permanent magnet, a ferrite member to which a direct-current magnetic field is applied by the permanent magnet, a first center electrode having one end electrically connected to a first input/output port and the other end electrically connected to a second input/output port, the first center electrode being provided on the ferrite member, a second center electrode having one end electrically connected to the second input/output port and the other end electrically connected to a ground port, the second center electrode being arranged on the ferrite member so as to intersect with the first center electrode, with the first center electrode and the second center electrode being electrically insulated from each other, a first matching capacitor electrically connected between the first input/output port and the second input/output port, a resistor electrically connected between the first input/output port and the second input/output port, a second matching capacitor electrically connected between the second input/output port and the ground port, a first input/output terminal electrically connected to the first input/output port, and a second input/output terminal electrically connected to the second input/output port. One of the first input/output port and the second input/output port defines an input port, and the other one defines an output port, and the intersection angle between the first center electrode and the second center electrode is adjusted to be greater than about 90 degrees, and the susceptance part of the admittance of the first input/output port is positive in the pass-band center frequency.

Preferably, the admittance of the first input/output port has a complex conjugate relationship with an external circuit.

The two-port isolator may further include a capacitor electrically connected in series between the first input/output port and the first input/output terminal.

The two-port isolator may further include an inductor electrically connected in series between the first input/output port and the first input/output terminal.

The two-port isolator may further include an inductor having one end electrically connected to the first input/output port and the other end electrically connected to the first input/output terminal, and a capacitor shunt-connected to the other end of the inductor.

The two-port isolator may further include a capacitor electrically connected between the first input/output port and the ground.

According to another preferred embodiment of the present invention, a two-port isolator includes a permanent magnet, a ferrite member to which a direct-current magnetic field is applied by the permanent magnet, a first center electrode having one end electrically connected to a first input/output port and the other end electrically connected to a second input/output port, the first center electrode being provided on the ferrite member, a second center electrode having one end electrically connected to the second input/output port and the other end electrically connected to a ground port, the second center electrode being arranged on the ferrite member so as to intersect with the first center electrode, with the first center electrode and the second center electrode being electrically insulated from each other, a first matching capacitor electrically connected between the first input/output port and the second input/output port, a resistor electrically connected between the first input/output port and the second input/output port, a second matching capacitor electrically connected between the second input/output port and the ground port. One of the first input/output port and the second input/output port defines an input port, and the other one defines an output port, and the intersection angle between the first center electrode and the second center electrode is an angle other than 90 degrees.

According to another preferred embodiment of the present invention, a communication apparatus including a two-port isolator as described above is provided.

According to another preferred embodiment of the present invention, a characteristic adjusting method for a two-port isolator is provided. The two-port isolator includes a permanent magnet, a ferrite member to which a direct-current magnetic field is applied by the permanent magnet, a first center electrode having one end electrically connected to a first input/output port and the other end electrically connected to a second input/output port, the first center electrode being provided on the ferrite member, a second center electrode having one end electrically connected to the second input/output port and the other end electrically connected to a ground port, the second center electrode being arranged on the ferrite member so as to intersect with the first center electrode, with the first center electrode and the second center electrode being electrically insulated from each other, a first matching capacitor electrically connected between the first input/output port and the second input/output port, a resistor electrically connected between the first input/output port and the second input/output port, a second matching capacitor electrically connected between the second input/output port and the ground port, a first input/output terminal electrically connected to the first input/output port, and a second input/output terminal electrically connected to the second input/output port. One of the first input/output port and the second input/output port defines an input port, and the other one defines an output port, and the susceptance part of the admittance of the first input/output port is adjusted by changing the intersection angle between the first center electrode and the second center electrode.

According to preferred embodiments of the present invention, by adjusting the intersection angle between the first and second center electrodes to be less than about 90 degrees, the susceptance part of the admittance of the first input/output port is set to be negative in the band-pass center frequency. Alternatively, by adjusting the intersection angle between the first and second center electrodes to be greater than about 90 degrees, the susceptance part of the admittance of the first input/output port is set to be positive in the band-pass center frequency. This easily enables the admittance of the first input/output port to have a complex conjugate relationship with an external circuit. Therefore, adjustment of the admittance of the first input/output port is facilitated. As a result, a two-port isolator in which matching of the admittance of a first input/output port is adjusted, and a communication apparatus including the two-port isolator are obtained.

These and various other features, elements, steps, characteristics and advantages of the present invention will become more apparent from the following detailed description of preferred embodiments thereof with reference to the attached drawings.

DETAILED DESCRIPTION OF PREFERRED EMBODIMENTS

Two-port isolators, a characteristic adjusting method therefor, and a communication apparatus according to preferred embodiments of the present invention are described below with reference to the accompanying drawings.

First Preferred Embodiment (FIGS. 1 to 8)

Figure 1:
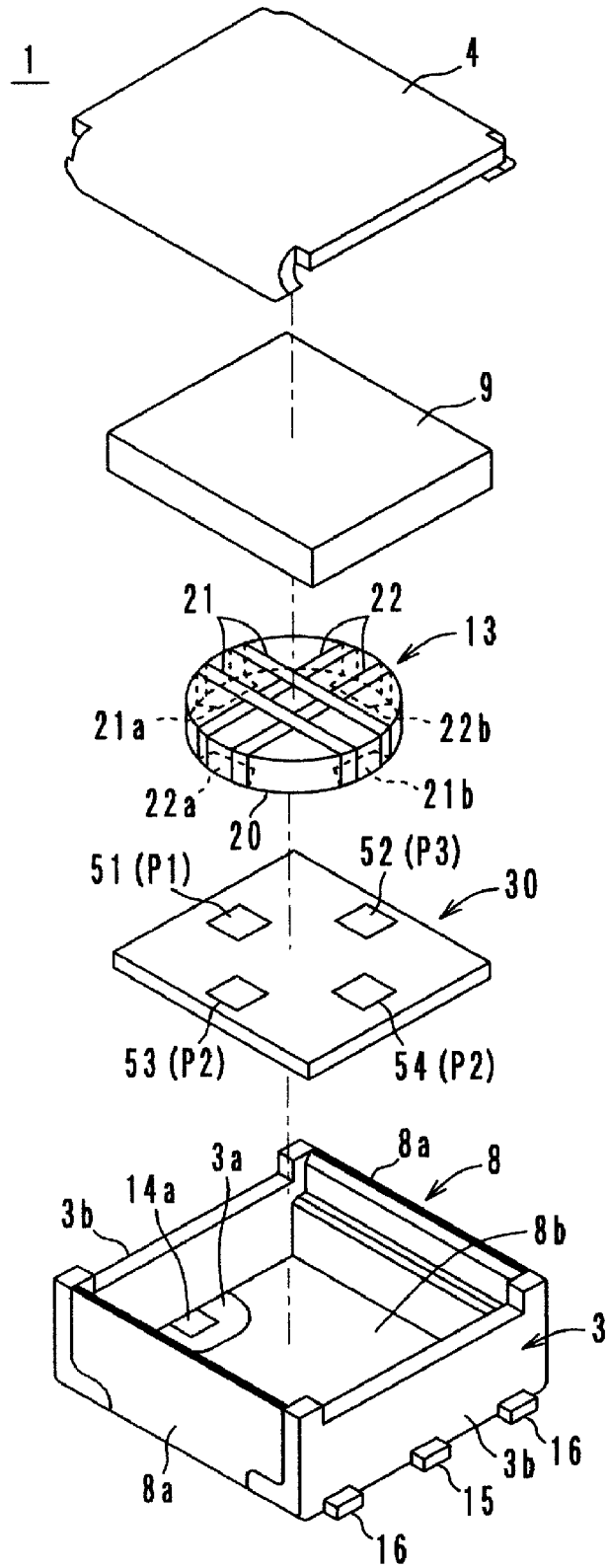
FIG. 1 is an exploded perspective view showing a two-port isolator according to a preferred embodiment of the present invention.

FIG. 1 is an exploded perspective view of a two-port isolator 1 according to a preferred embodiment of the present invention. The two-port isolator 1 is a lumped-constant isolator. As shown in FIG. 1, the two-port isolator 1 includes a metal case having an upper metal case portion 4 and a lower metal case portion 8, a resin case 3 integrated with the lower metal case portion 8, a permanent magnet member 9, a center electrode assembly 13 including a ferrite member 20 and center electrodes 21 and 22, and a laminated base 30.

The lower metal case portion 8 includes right and left side walls 8*b* and 8*a*. The lower metal case portion 8 is integrally molded with the resin case 3 preferably by insertion molding. A bottom wall 8*b* of the lower metal case portion 8 has a pair of opposite sides. From one side, two ground terminals 16 extend (two ground terminals from the other side are not shown). For providing a magnetic circuit, the upper metal case portion 4 and the lower metal case portion 8 are preferably made of ferromagnetic material, such as soft iron, and their surfaces are plated with Ag or Cu.

In the center electrode assembly 13, the center electrodes 21 and 22 are arranged to intersect with each other above the ferrite member 20, which is disk-shaped and made of microwave ferrite, with an insulating layer (not shown) provided therebetween. The intersection angle θ between the center electrodes 21 and 22 is adjusted to be different from 90 degrees. In the first preferred embodiment of the present invention, the center electrodes 21 and 22 are two lines whose outermost widths are parallel. However, the center electrodes 21 and 22 may include one line, or three or more lines, and may have nonparallel or curved shapes. Opposite ends 21*a* and 21*b* of the first center electrode 21 and opposite ends 22*a* and 22*b* of the second center electrode 22 extend to a bottom surface of the ferrite member 20. The ends 21*a* to 22*b* are spaced from one another.

The center electrodes 21 and 22 may be wound around the ferrite member 20 using copper foil, or may be formed by printing silver paste on or inside the ferrite member 20. Alternatively, the center electrodes 21 and 22 may be formed by a laminated base, as described in Japanese Unexamined Patent Application Publication No. 9-232818. However, by using the printing of silver paste, the center electrodes 21 and 22 have high positional accuracy, such that connection to the laminated base 30 is stable. In particular, when connection is made by using minute connecting electrodes 51 to 54 for center electrodes, the formation of the center electrodes 21 and 22 by printing produces outstanding reliability and usability.

Figure 2:
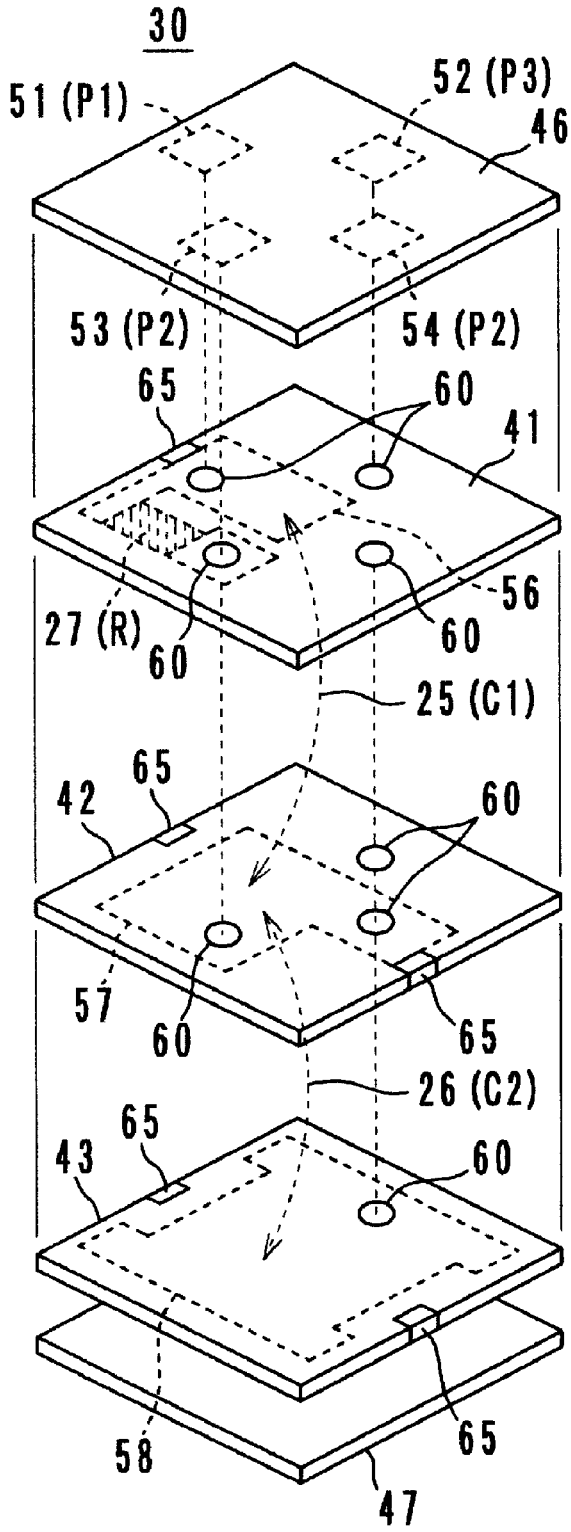
FIG. 2 is an exploded perspective view showing the laminated base shown in FIG. 1.

As shown in FIG. 2, the laminated base 30 includes the connecting electrodes 51 to 54 for center electrodes, a dielectric sheet 41 including a capacitor electrode 56 and a resistor 27 on its reverse surface, a dielectric sheet 42 having a capacitor electrode 57 on its reverse surface, and a dielectric sheet 43 having a ground electrode 58 on its reverse surface. The connecting electrode 51 defines an input port P1. The connecting electrodes 53 and 54 define output ports P2. The connecting electrode 52 defines a ground port P3.

The laminated base 30 is produced in the following manner. The dielectric sheets 41 to 43 are formed of low temperature sintering dielectric material which includes a principal component of Al2O3 and which includes, as a second component, one or more of $SiO_2$, SrO, CaO, PbO, $Na_2O$, $K_2O$, MgO, BaO, $CeO_2$, and $B_2O_3$.

Next, contraction preventing sheets 46 and 47 are produced. The contraction preventing sheets 46 and 47 are not burnt in burning conditions (particularly a burning temperature of 1000 degrees Centigrade or below) of the laminated base 30, and prevent burning contraction in base-plane directions (X and Y directions) of the laminated base 30. The material used for the contraction preventing sheets 46 and 47 is a mixture of alumina powder and stabilized zirconia powder. The sheets 41 to 43, 46, and 47 have thicknesses of about 10 μm to about 200 μm.

The electrodes 51 to 54 and 56 to 58 are formed on reverse surfaces of the sheets 41 to 43, 46, and 47. As the material for the electrodes 51 to 54, and 56 to 58, a material, such as Ag, Cu, or Ag—Pd, which has a low resistivity and which can be burnt simultaneously with the dielectric sheets 41 to 43, is used.

The resistor 27 is formed on a reverse surface of the dielectric sheet 41 by a method such as pattern printing. As the material for the resistor 27, cermet, carbon, ruthenium, or other suitable material, may be preferably used. The resistor 27 may be arranged on an upper surface of the laminated base 30, or may be formed as a chip resistor.

Via holes 60 and via holes 65 are formed by making holes for via holes beforehand using a method such as laser beam machining or punching, and filling the holes with conductive paste.

The capacitor electrode 57 opposes the ground electrode 58, with the dielectric sheet disposed therebetween. The capacitor electrode 57 and the ground electrode 58 define a matching capacitor 26. The matching capacitors 25 and 26, the resistor 27, the electrodes 51 to 54, and the via holes 60 and 65 define an electrical circuit in the laminated base 30.

The above-described dielectric sheets 41 to 43 are stacked. The stacked dielectric sheets 41 to 43 are vertically arranged between the contraction preventing sheets 46 and 47. The integrated body is burnt. This produces a sintered body. After that, by using ultrasonic cleaning, wet honing, or other suitable method, unburnt portions of the contraction preventing sheets 46 and 47 are removed, such that the laminated base 30 in FIG. 1 is produced.

As shown in FIG. 1, the resin case 3 has a bottom surface 3*a* and two side surfaces 3*b*. On the bottom surface 3*a*, the bottom surface 8*b* of the lower metal case portion 8 is exposed in a broad area. In the resin case 3, an input terminal 14 (see FIG. 14) and an output terminal 15 are insertion-molded. One end of the input terminal 14 is exposed on an outer surface of the resin case 3 and defines an input extraction electrode 14*a*. One end of the output terminal 15 is exposed on an outer surface of the resin case 3 and defines an output extraction electrode (not shown). The ground terminals 16 extend from opposite outer surfaces of the resin case 3 to the exterior.

The above-described component parts are assembled in the following manner. As shown in FIG. 1, the ends 21*a* to 22*b* of the center electrodes 21 and 22 in the center electrode assembly 13 are electrically connected to the connecting electrodes 51 to 54 provided on the surface of the laminated base 30 by soldering. This mounts the center electrode assembly 13 on the laminated base 30. Soldering of the center electrodes 21 and 22 and the connecting electrodes 51 to 54 may be efficiently performed for a motherboard used as the laminated base 30. The permanent magnet member 9 is disposed between the upper metal case portion 4 and the central electrode assembly 13.

The laminated base 30 is accommodated in the resin case 3 integrated with the lower metal case portion 8. The ground electrode 58 provided on the laminated base 30 is fixedly connected to the bottom wall 8*b* by soldering. Similarly, the two via holes 65 on an end surface of the laminated base 30 are fixedly connected to the input extraction electrode 14*a* and the output extraction electrode by soldering.

The lower metal case portion 8 and the upper metal case portion 4 are joined by soldering to form the metal case. The metal case also functions as a yoke. In other words, the metal case generates a magnetic path surrounding the permanent magnet member 9, the center electrode assembly 13, and the laminated base 30. The permanent magnet member 9 applies a DC magnetic field to the ferrite member 20.

Figure 3:
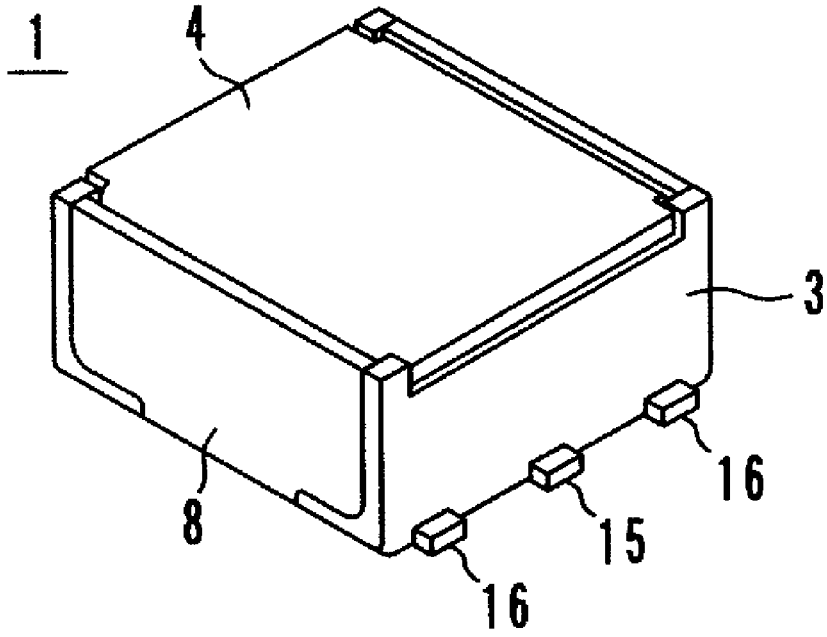
FIG. 3 is an exterior perspective view showing the two-port isolator shown in FIG. 1.
Figure 4:
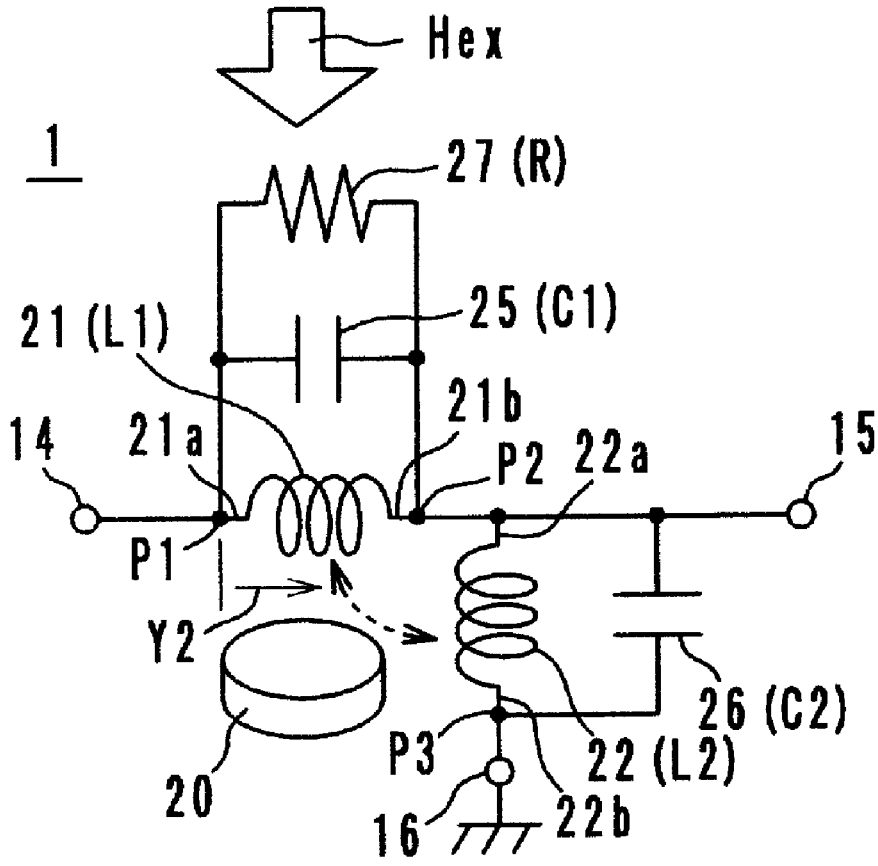
FIG. 4 is an equivalent electrical circuit diagram showing the two-port isolator shown in FIG. 1.
Figure 21:
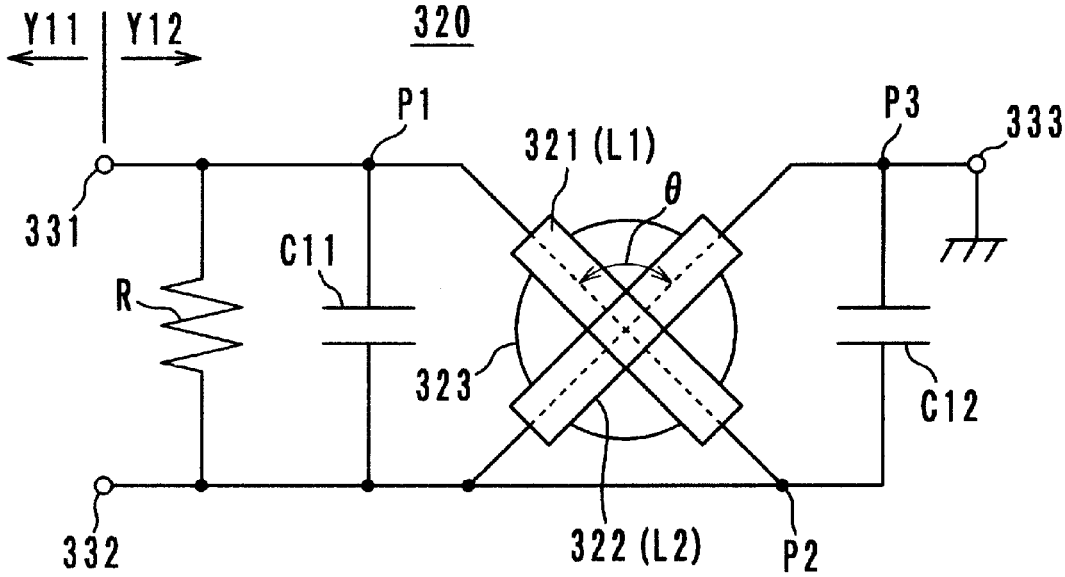
FIG. 21 PRIOR ART
FIG. 21 is an equivalent electrical circuit diagram showing another two-port isolator of the related art.

In the above-described manner, the two-port isolator 1 shown in FIG. 3 is produced. FIG. 4 shows an equivalent electrical circuit of the two-port isolator 1. This equivalent electrical circuit is substantially the same as that of the two-port isolator 320 of the related art in FIG. 21. The end 21*a* of the first center electrode 21 is electrically connected to the input terminal 14 through the input port P1 (the connecting electrode 51). The other end 21*b* of the first center electrode 21 is electrically connected to the output terminal 15 through the output port P2 (the connecting electrode 54). The end 22*a* of the second center electrode 22 is electrically connected to the output terminal 15 through the output port P2 (the connecting electrode 53). The other end 22*b* of the second center electrode 22 is electrically connected to the ground terminal 16 through the ground port P3 (the connecting electrode 52). The parallel RC circuit including the matching capacitor 25 and the resistor 27 is electrically connected between the output port P2 and the ground port P3. The ground port P3 is electrically connected to the ground terminal 16.

Differently from the two-port isolator 320 (in FIG. 21) of the related art in which the intersection angle θ between the center electrodes 21 and 22 is 90 degrees, in the two-port isolator 1 having the above-described structure, the intersection angle θ is adjusted to be different from 90 degrees, and the input admittance of the input port P1 has a complex conjugate relationship with an external circuit. Therefore, matching of input admittance Y2 at the input port P1 is easily adjusted. As a result, the two-port isolator 1 is obtained, in which a power loss caused by problems in matching adjustment is reduced.

Figure 5:
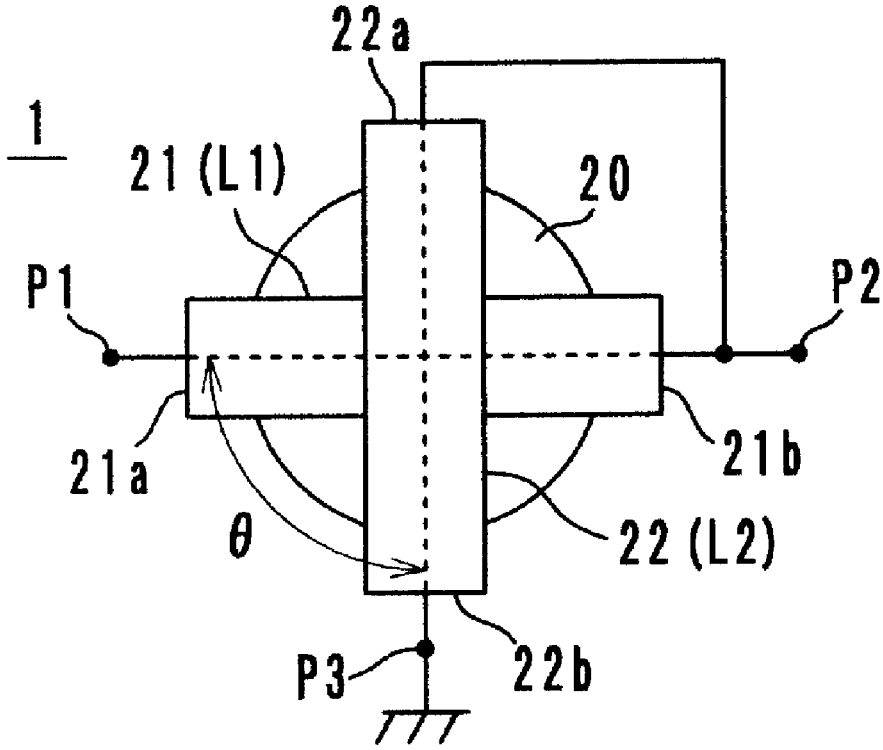
FIG. 5 is a plan view illustrating the intersection angle θ between center electrodes.

As shown in FIG. 5, the intersection angle θ represents an angle at which the center lines of the outermost widths of the center electrodes 21 and 22 intersect with each other. In other words, the intersection angle θ represents an angle of the end 21*a* of the first center electrode 21 with respect to the input port P1 and an angle of the end 22*b* of the second center electrode 22 with respect to the ground port P3.

The following Table 1 shows values of the input admittance Y2 (pass-band center frequency: 926.5 MHz) of the input port P1 when the intersection angle θ between the center electrodes 21 and 22 of the two-port isolator 1 are variously changed. For comparison, Table 1 also shows the input admittance Y12 of the two-port isolator 320 (shown in FIG. 21) in which the intersection angle θ between the center electrodes 21 and 22 is 90 degrees.

TABLE 1

| | L1 [nH] | L2 [nH] | θ [°] | C1 [pF] | C2 [pF] | R [Ω] | Input Admittance (Y2) Conductance (S) | Input Admittance (Y2) Susceptance (S) |
|---|---|---|---|---|---|---|---|---|
| Example 1 | 0.7 | 0.7 | 60 | 15.6 | 15.6 | 60 | 0.022 | −0.067 |
| Example 2 | 0.7 | 0.7 | 70 | 17.2 | 17.2 | 60 | 0.021 | −0.041 |
| Example 3 | 0.7 | 0.7 | 80 | 19.5 | 19.5 | 60 | 0.020 | −0.019 |
| Related Art | 0.7 | 0.7 | 90 | 22.3 | 22.3 | 60 | 0.020 | 0.000 |
| Example 4 | 0.7 | 0.7 | 100 | 26.2 | 26.2 | 60 | 0.019 | 0.020 |
| Example 5 | 0.7 | 0.7 | 110 | 31.5 | 31.5 | 60 | 0.019 | 0.041 |
| Example 6 | 0.7 | 0.7 | 120 | 38.7 | 38.7 | 60 | 0.019 | 0.067 |

Figure 6:
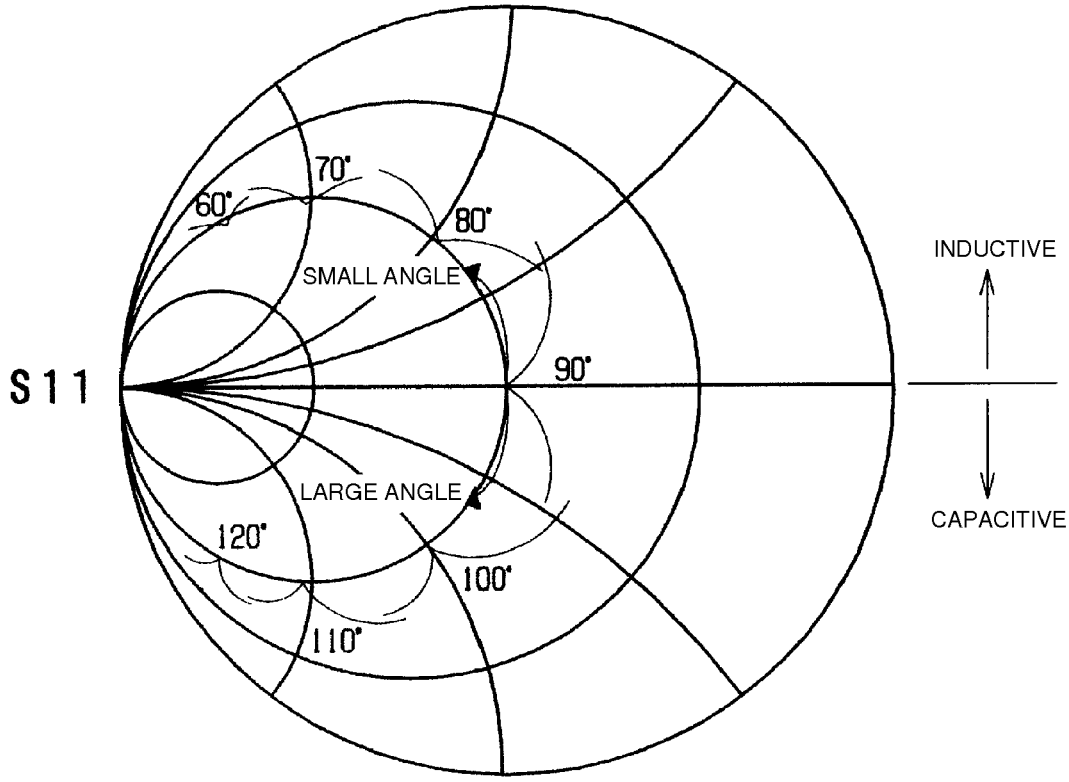
FIG. 6 is an input admittance chart illustrating the two-port isolator shown in FIG. 1.
Figure 7:
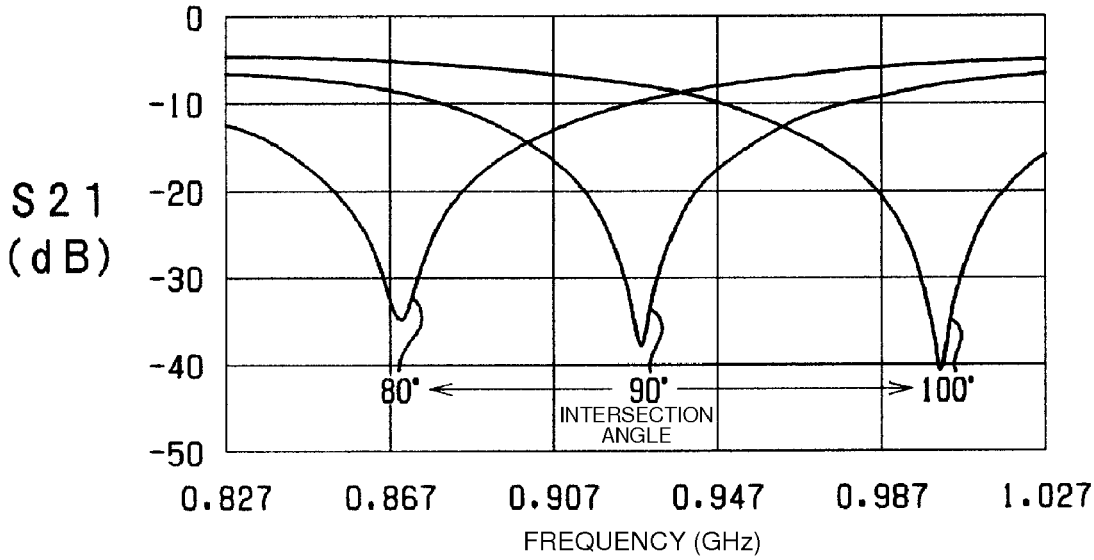
FIG. 7 is a graph showing resonant frequencies of isolation.
Figure 8:
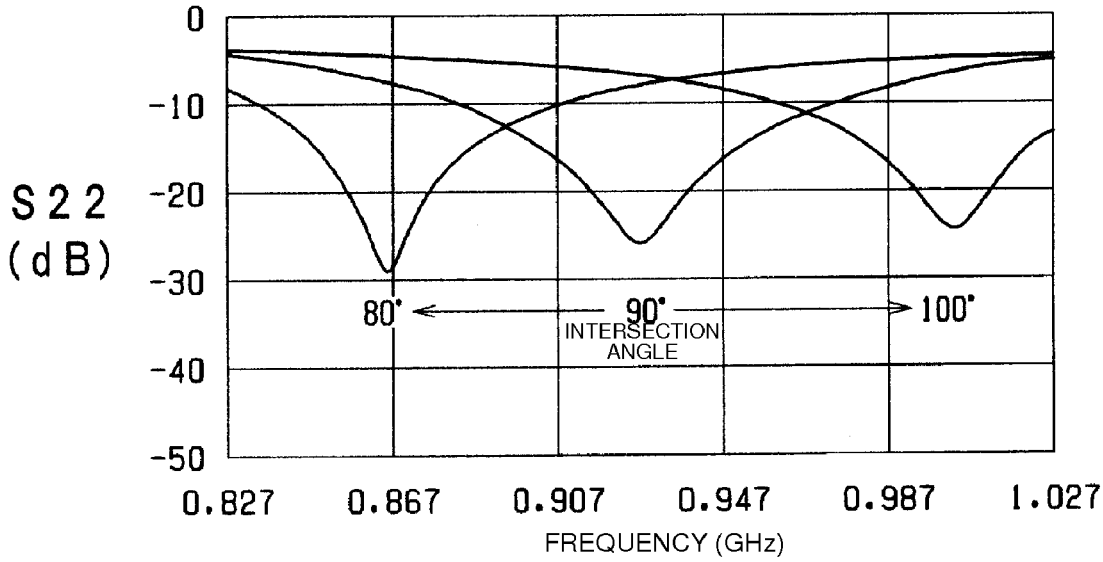
FIG. 8 is a graph showing resonant frequencies of output return loss at an output port P2.

In addition, FIG. 6 is an input admittance chart illustrating the two-port isolator shown in FIG. 1. The inductances in Table 1 are the self-inductances of the center electrodes 21 and 22 when a relative permeability is assumed to be 1. Actually, values obtained by multiplying the self-inductances by an effective permeability caused by the ferrite member 20 and other elements are the inductances L1 and L2.

The mutual inductance between the center electrodes 21 and 22 decreases when the intersection angle θ is increased, and increases when the intersection angle θ is decreased. Accordingly, a change in intersection angle θ shifts not only the input admittance Y2 of the input port P1 but also the resonant frequency (see FIG. 7) of isolation and a resonant frequency (see FIG. 8) of an output return loss at the output port P2. Therefore, when changing the intersection angle θ, as shown in Table 1, the capacitance C1 of the matching capacitor 25 must be adjusted such that the resonant frequency of isolation is a desired frequency, and the capacitance C2 of the matching capacitor 26 must be adjusted such that the resonant frequency of the output return loss is a desired frequency.

Table 1 and FIG. 6 indicate that, in Examples 1 to 3, by setting the intersection angle θ between the center electrodes 21 and 22 to be less than about 90 degrees, the susceptance part of the admittance Y2 of the input port P1 can be set to be negative (inductive) in the pass-band center frequency. At this time, the smaller the intersection angle θ, the larger the absolute value of the susceptance.

Conversely, in Examples 4 to 6, by setting the intersection angle θ to be greater than about 90 degrees, the susceptance part of the admittance Y2 of the input port P1 can be set to be positive (capacitive) in the pass-band center frequency. At this time, the greater the intersection angle θ, the greater the absolute value of the susceptance. In addition, when the intersection angle θ is 90 degrees, the susceptance is zero.

Figure 20:
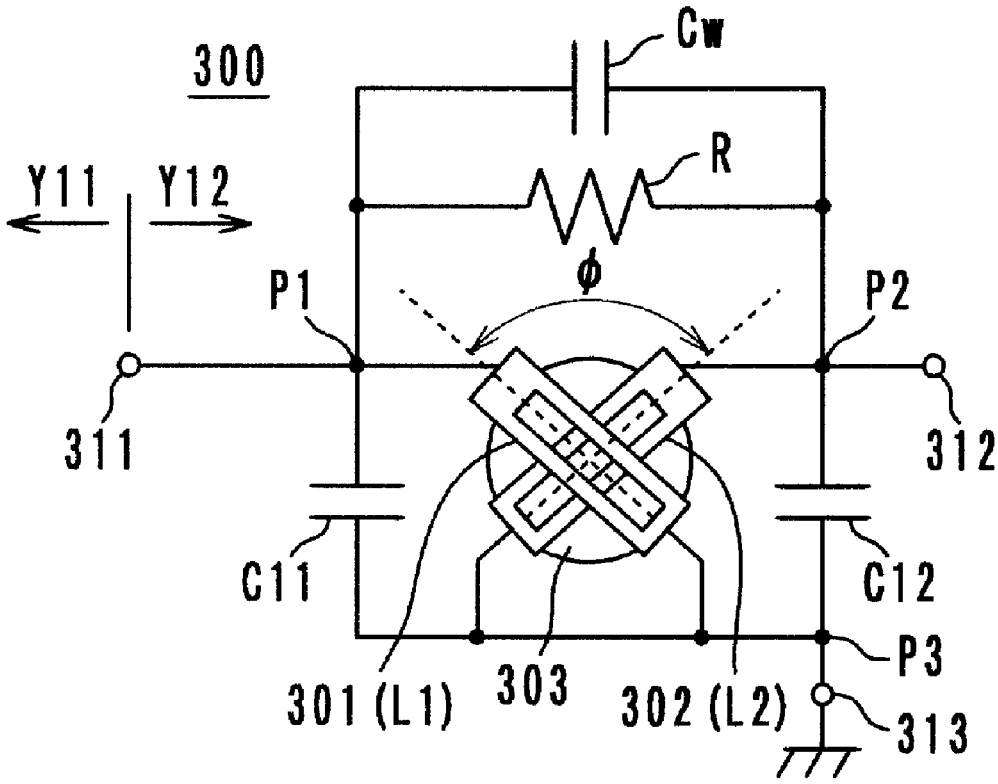
FIG. 20 PRIOR ART
FIG. 20 is an equivalent electrical circuit diagram showing a two-port isolator of the related art.

As described above, by changing the intersection angle θ between the center electrodes 21 and 22, the susceptance can be changed without substantially changing the conductance. The ferrite member 20 has tensor permeability and its elements are complex numbers. Thus, the self-inductances and mutual inductance of the center electrodes 21 and 22 are represented by complex numbers. In addition, a change in intersection angle θ between the center electrodes 21 and 22 changes the mutual inductance of the center electrodes 21 and 22 and changes the input admittance Y2. In the case of the two-port isolator 300 of the related art in FIG. 20, a change in intersection angle θ changes the mutual conductance, and changes both the real part (conductance) and imaginary part (susceptance) of the input admittance Y12. This is because the mutual inductance is a complex number and a change in intersection angle θ changes both the real part and the imaginary part.

In the first preferred embodiment, although a change in intersection angle θ changes the mutual inductance similarly to that of the two-port isolator 300, only the susceptance part of the admittance Y2 changes and the conductance does not change. This is because, when viewed from the input port P1, the center electrodes 21 and 22 are connected in series so as to offset a change in real part of the mutual inductance.

Therefore, by changing the intersection angle θ between the center electrodes 21 and 22, the admittance Y2 of the input port P1 is easily set to have a complex conjugate relationship with an external circuit. As a result, matching of the admittance Y2 of the input port P1 is easily adjusted, thus reducing a power loss caused by mismatching. In addition, when the intersection angle θ is small, the size of the capacitors C1 and C2 of the two-port isolator 1 is reduced, thus reducing the size of the two-port isolator 1.

It is preferable for the intersection angle θ to be in the range of about 60 to about 87 degrees, and about 93 to about 120 degrees. This is because, when the intersection angle θ is too close to 90 degrees, it is not effective because the susceptance can be changed only to a too small degree, while, when the intersection angle θ is too far from the intersection angle θ, it is not practical because the susceptance is changed to a excessive degree.

Figure 9:
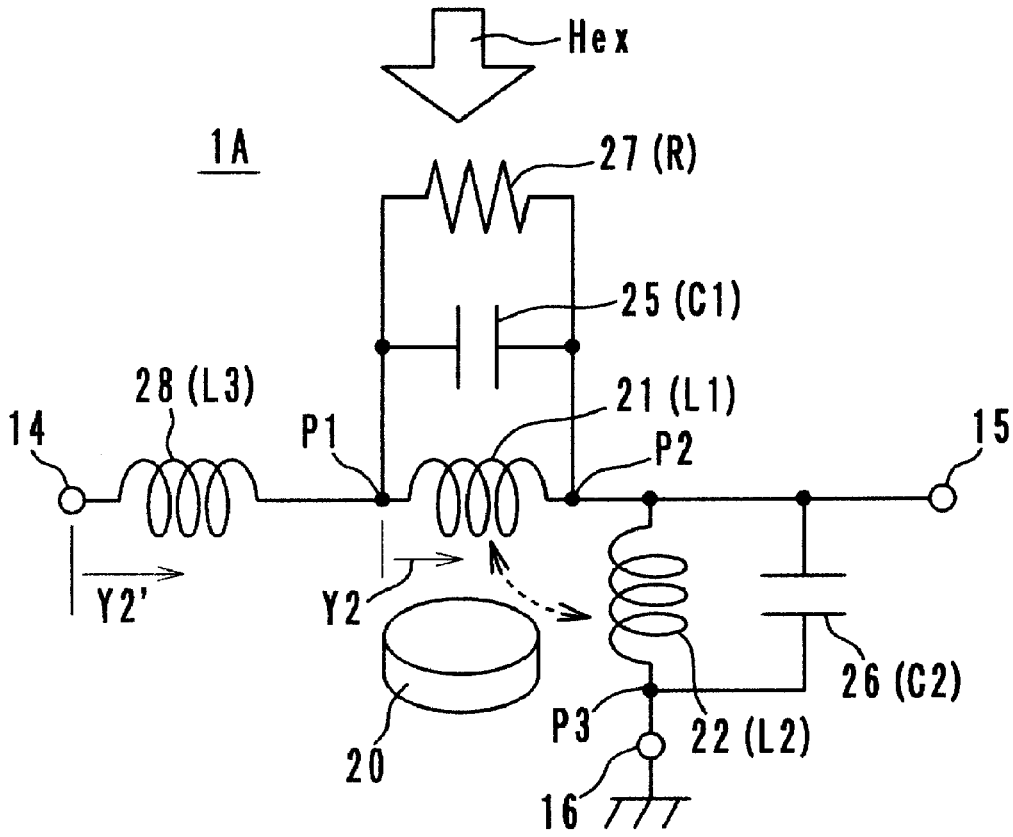
FIG. 9 is an equivalent electrical circuit diagram showing a two-port isolator according to another preferred embodiment of the present invention.
Figure 10:
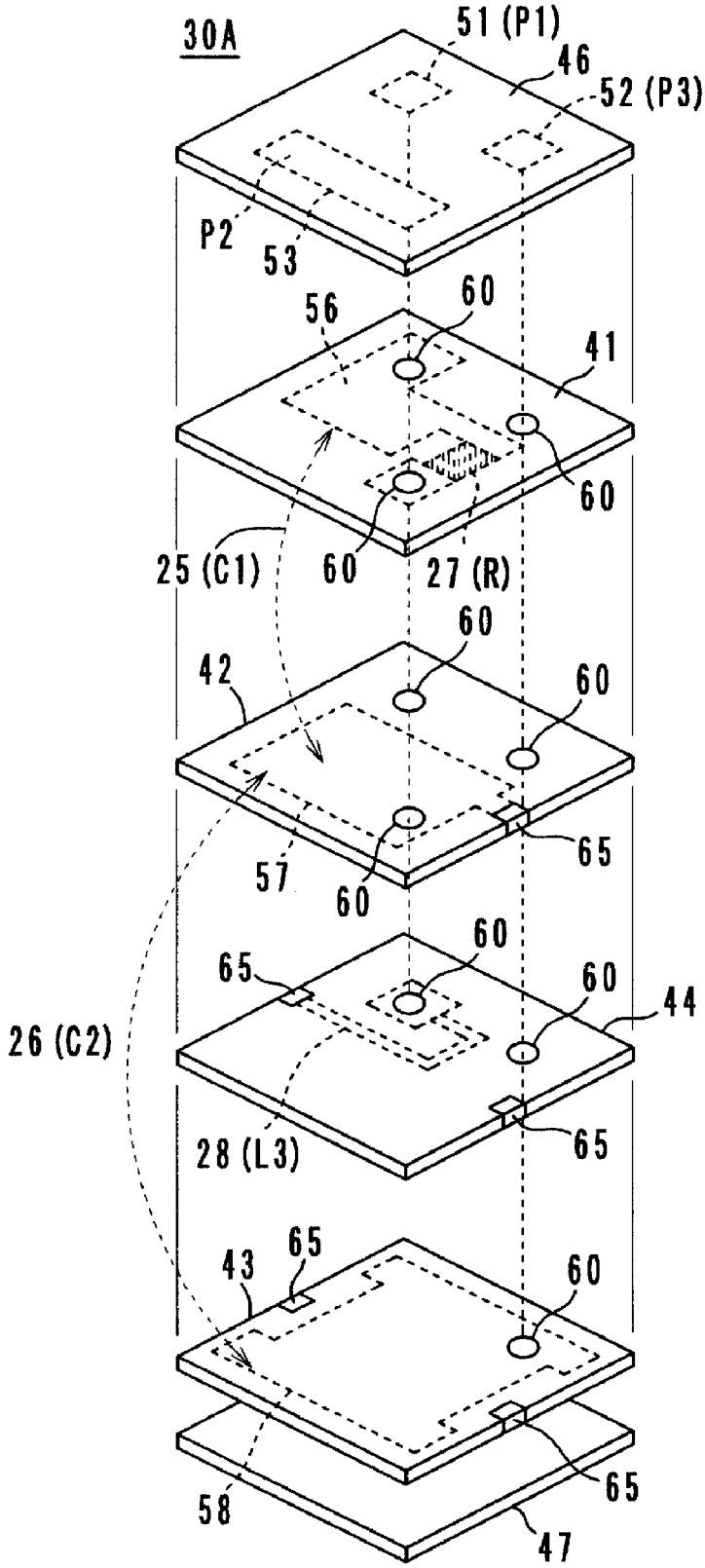
FIG. 10 is an exploded perspective view showing the two-port isolator shown in FIG. 9.

Second Preferred Embodiment (FIGS. 9 and 10)

As FIG. 9 shows, a two-port isolator 1A according to a second preferred embodiment of the present invention includes an inductor 28 connected in series between the input terminal 14 and the input port P1 so as to increase an input admittance Y2' (observed from the input terminal 14) to greater than about 0.02 S (i.e., an impedance lower than 50Ω). The two-port isolator 1A is configured such that, in the structure shown in FIG. 1, the laminated base 30A shown in FIG. 10 is used instead of the laminated base 30. FIG. 10 shows a dielectric sheet 44 and an inductor 28. In the second preferred embodiment, the inductor 28 has an inductance L3 and is built into the laminated base 30A. However, alternatively, a chip inductor or air-core coil may be surface-mounted on the laminated base 30A.

The following Table 2 shows values of the input admittance Y2' (viewed from the input terminal 14) (pass-band center frequency: 926.5 MHz) when the intersection angle θ between the center electrodes 21 and 22 of the two-port isolator 1A is increased to greater than about 90 degrees. Since the intersection angle θ is set to be greater than about 90 degrees, the susceptance part of input admittance Y2 at the input port P1 is positive in the pass-band center frequency (see Examples 4 to 6 in Table 1). The susceptance part of the input admittance Y2' of the input terminal 14 is approximately zero.

TABLE 2

| | L1 [nH] | L2 [nH] | L3 [nH] | θ [°] | C1 [pF] | C2 [pF] | R [Ω] | Input Admittance (Y2') Conductance (S) | Input Admittance (Y2') Susceptance (S) |
|---|---|---|---|---|---|---|---|---|---|
| Example 7 | 0.7 | 0.7 | 4.5 | 100 | 26.2 | 26.2 | 60 | 0.039 | 0.000 |
| Example 8 | 0.7 | 0.7 | 3.4 | 110 | 31.5 | 31.5 | 60 | 0.106 | 0.001 |
| Example 9 | 0.7 | 0.7 | 2.4 | 120 | 38.7 | 38.7 | 60 | 0.249 | −0.004 |

Table 2 indicates that, by setting the intersection angle θ between the center electrodes 21 and 22 to be greater than about 90 degrees, only connection of one inductor 28 to the input port P1 increases the input admittance Y2' (viewed from the input terminal 14) to greater than about 0.02 S. Conversely, in the case of the two-port isolator 320 (see FIG. 21) of the related art in which the intersection angle θ between the center electrodes 21 and 22 is 90 degrees, in order to increase the input admittance Y to greater than about 0.02 S (i.e., an impedance lower than 50Ω), a series inductor and a parallel capacitor must be connected to the input port P1. Differently from the two-port isolator 320, the size and costs of the two-port isolator 1A are greatly reduced. In addition, the number of connecting points between circuit elements is reduced, such that the reliability of the two-port isolator 1A is increased.

Figure 11:
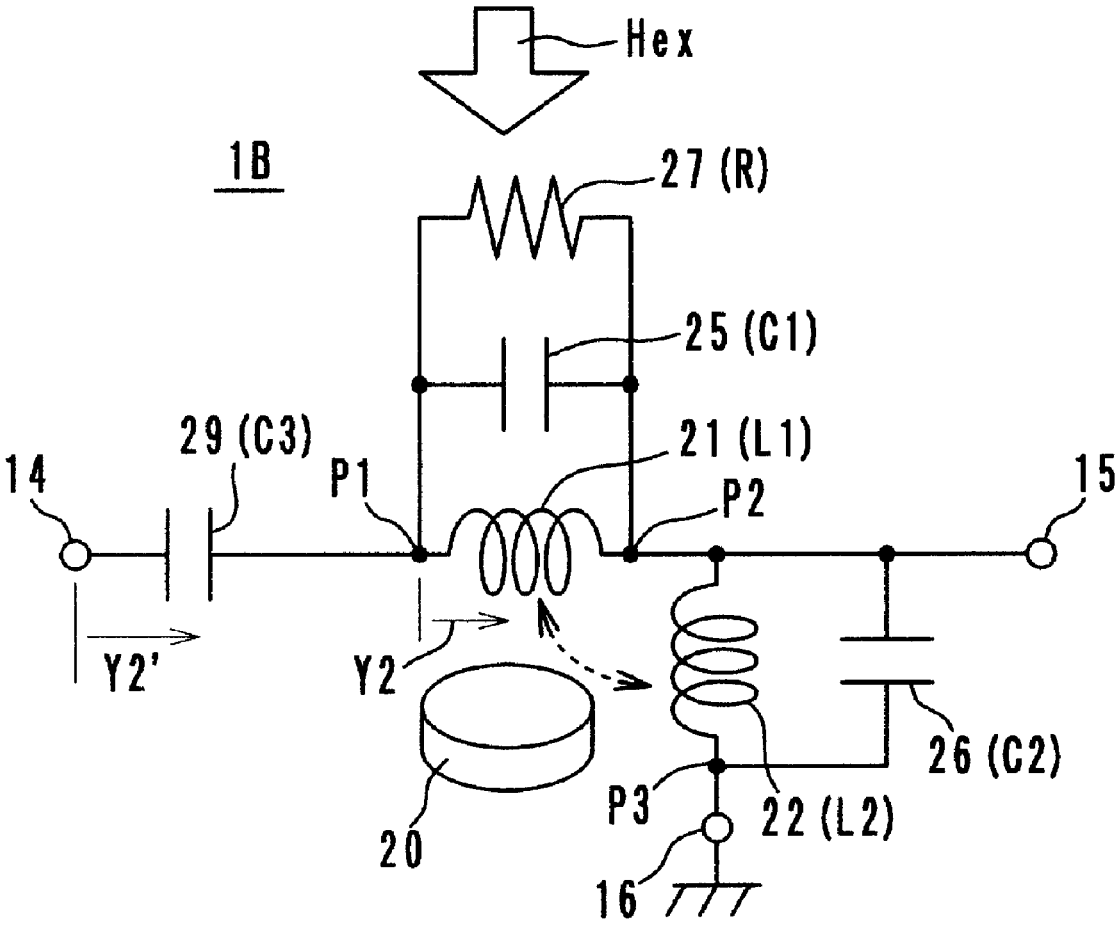
FIG. 11 is an equivalent electrical circuit diagram showing a two-port isolator according to still another preferred embodiment of the present invention.
Figure 12:
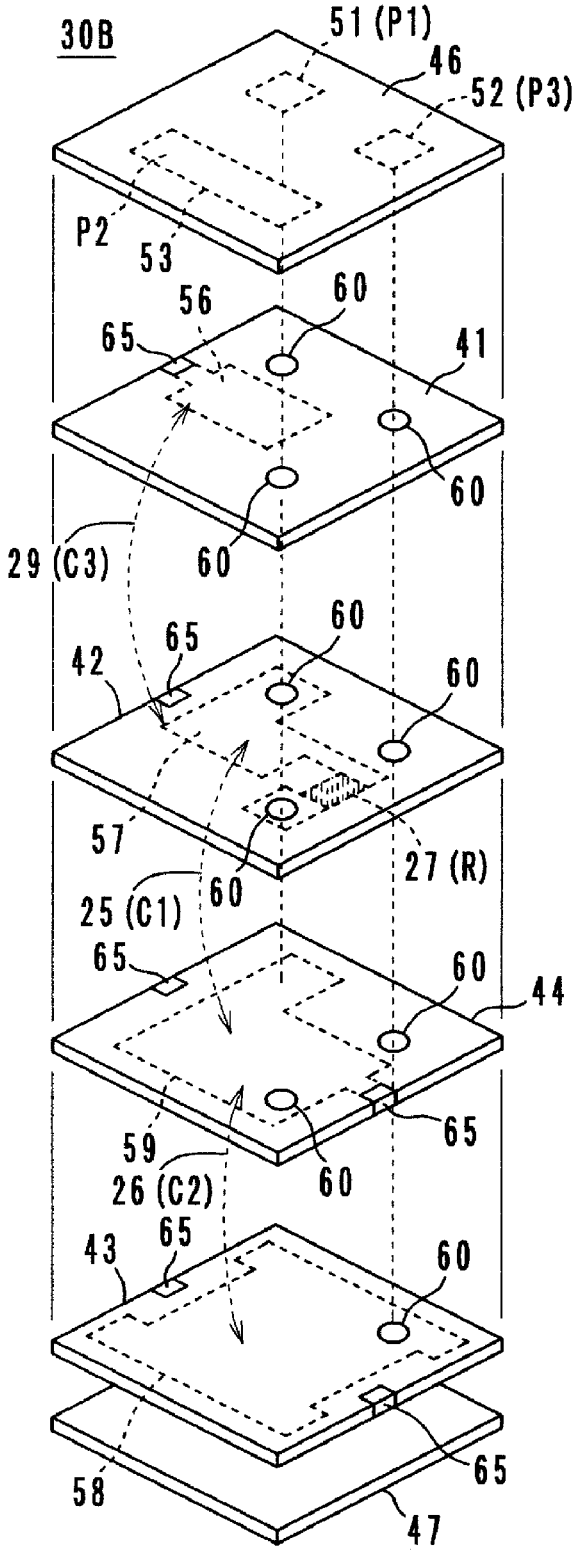
FIG. 12 is an exploded perspective view showing the two-port isolator shown in FIG. 11.

Third Preferred Embodiment (FIGS. 11 and 12)

As FIG. 11 shows, a two-port isolator 1B according to a third preferred embodiment of the present invention includes a capacitor 29 connected in series between the input terminal 14 and the input port P1 so as to increase the input admittance Y2' (viewed from the input terminal 14) to greater than about 0.02 S (i.e., an impedance lower than 50Ω). The two-port isolator 1B is configured such that, in the structure shown in FIG. 1, the laminated base 30B is used instead of the laminated base 30 in FIG. 2. FIG. 12 shows a dielectric sheet 44 and a capacitor electrode 59. In the third preferred embodiment, the capacitor 29 has a capacitance C3 and is built into the laminated base 30B. A chip capacitor is surface-mounted on the laminated base 30B.

The following Table 3 shows values of the input admittance Y2' (viewed from the input terminal 14) (pass-band center frequency: 926.5 MHz) when the intersection angle θ between the center electrodes 21 and 22 of the two-port isolator 1B is reduced to less than about 90 degrees. Since the intersection angle θ is set to be less than about 90 degrees, the susceptance part of the input admittance Y2 the input port P1 is negative in the pass-band center frequency (see Examples 1 to 3 in Table 1). The susceptance part of the input admittance Y2' of the input terminal 14 is approximately zero.

Table 3 indicates that, by setting the intersection angle θ between the center electrodes 21 and 22 to be less than about 90 degrees, only connection of the capacitor 29 to the input port P1 increases the input admittance Y2' (viewed from the input terminal 14) to greater than about 0.02 S. As a result, the size and cost of the two-port isolator 1B are greatly reduced. In addition, the number of connecting positions between elements is reduced, so that the reliability of the two-port isolator 1B is improved. The total capacitance of the capacitors C1, C2, and C3 can be set to be less than the total capacitance of the capacitors C1 and C2 of the two-port isolator 1A according to the second preferred embodiment. Thus, the sized of the two-port isolator 1B according to the third preferred embodiment is reduced as compared to the two-port isolator 1A according to the second preferred embodiment.

Fourth Preferred Embodiment (FIGS. 13 to 16)

Figure 13:
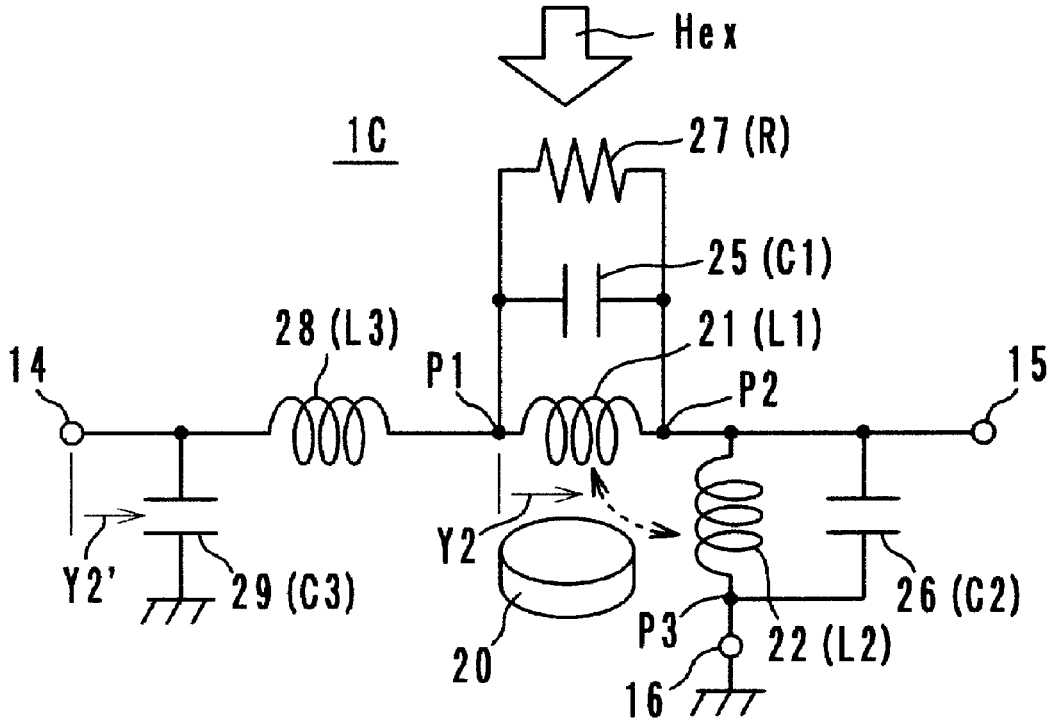
FIG. 13 is an equivalent electrical circuit diagram showing a two-port isolator according to still another preferred embodiment of the present invention.
Figure 14:
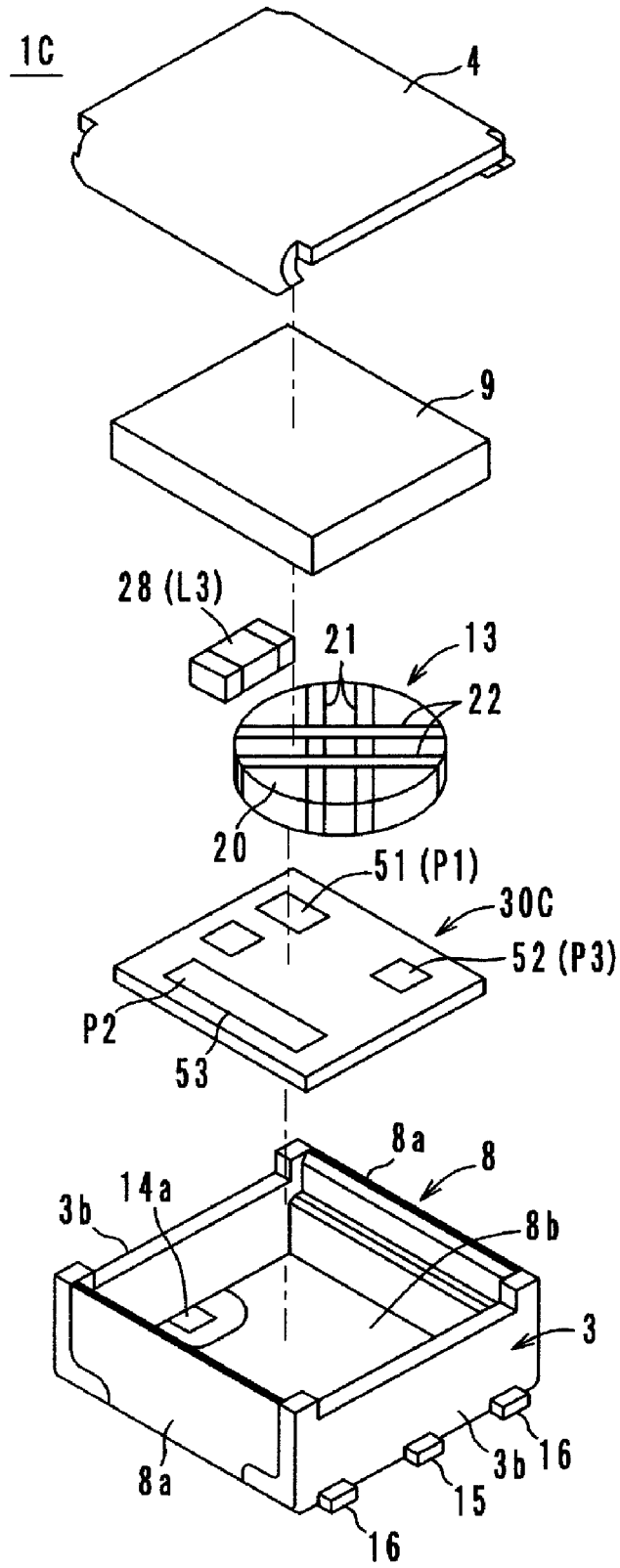
FIG. 14 is an exploded perspective view showing the two-port isolator shown in FIG. 13.
Figure 15:
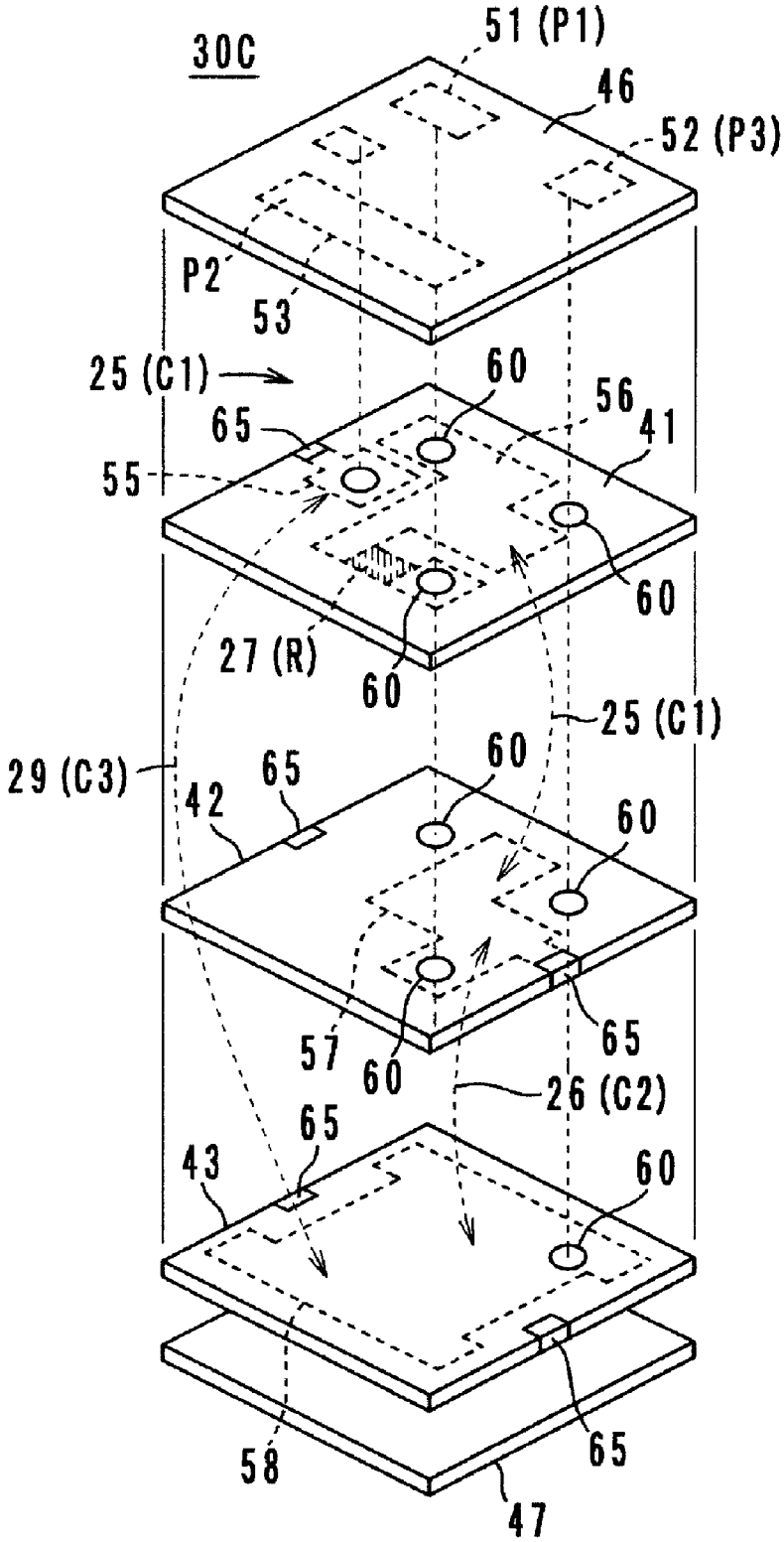
FIG. 15 is an exploded perspective view showing the laminated base shown in FIG. 14.

As FIG. 13 shows, a two-port isolator 1C according to a fourth preferred embodiment of the present invention includes a low-pass filter connected between the input terminal 14 and the input port P1 in order to eliminate harmonics, such as the second harmonic and the third harmonic. This low-pass filter includes an inductor 28 and a capacitor 29. In other words, the capacitor 29 is shunt-connected to one end of the inductor 28 which is connected in series to the input port P1. As shown in FIG. 14, the two-port isolator 1C is configured such that, in the structure shown in FIG. 1, a laminated base 30C and the chip inductor 28 are used instead of the laminated base 30. FIG. 15 is an exploded perspective view of the laminated base 30C. The laminated base 30C includes a capacitor electrode 55. In the fourth preferred embodiment, the chip inductor 28 is used. However, an air-core coil may be built into the laminated base 30C.

The following Table 4 shows values of attenuation in the second harmonic and the third harmonic when the intersection angle θ between the center electrodes 21 and 22 is set to be greater than about 90 degrees. For comparison, Table 4 also shows attenuation in harmonics of the two-port isolator 320 (in FIG. 21) of the related art in which the intersection angle θ between the center electrodes 21 and 22 is 90 degrees. Since the intersection angle θ is set to be greater than about 90 degrees in the two-port isolator 1C, the susceptance part of

TABLE 3

| | L1 [nH] | L2 [nH] | θ [°] | C1 [pF] | C2 [pF] | C3 [pF] | R [Ω] | Input Admittance (Y2') Conductance (S) | Input Admittance (Y2') Susceptance (S) |
|---|---|---|---|---|---|---|---|---|---|
| Example 10 | 0.7 | 0.7 | 60 | 15.6 | 15.6 | 12.8 | 60 | 0.219 | 0.000 |
| Example 11 | 0.7 | 0.7 | 70 | 17.2 | 17.2 | 8.9 | 60 | 0.100 | 0.000 |
| Example 12 | 0.7 | 0.7 | 80 | 19.5 | 19.5 | 6.8 | 60 | 0.039 | 0.001 |

input admittance Y2 of the input port P1 is positive in the pass-band center frequency (see Examples 4 to 6 in Table 1). Conversely, the susceptance part of the input admittance Y2' of the input terminal 14 is approximately zero. In addition, FIG. 16 is a graph showing attenuation characteristics of the two-port isolator 1C and the two-port isolator 320 of the related art.

TABLE 4

| | L1 [nH] | L2 [nH] | L3 [nH] | θ [°] | C1 [pF] | C2 [pF] | C3 [pF] | R [Ω] | Attenuation in 2nd Harmonic [dB] | Attenuation in 3rd Harmonic [dB] |
|---|---|---|---|---|---|---|---|---|---|---|
| Related Art | 0.7 | 0.7 | — | 90 | 22.3 | 22.3 | — | 60 | 14.4 | 19.6 |
| Example 13 | 0.7 | 0.7 | 8.8 | 100 | 26.2 | 26.2 | 3.4 | 60 | 26.6 | 40.2 |
| Example 14 | 0.7 | 0.7 | 6.9 | 110 | 31.5 | 31.5 | 7.0 | 60 | 32.5 | 46.0 |
| Example 15 | 0.7 | 0.7 | 4.8 | 120 | 38.7 | 38.7 | 11.2 | 60 | 35.3 | 48.8 |

Figure 16:
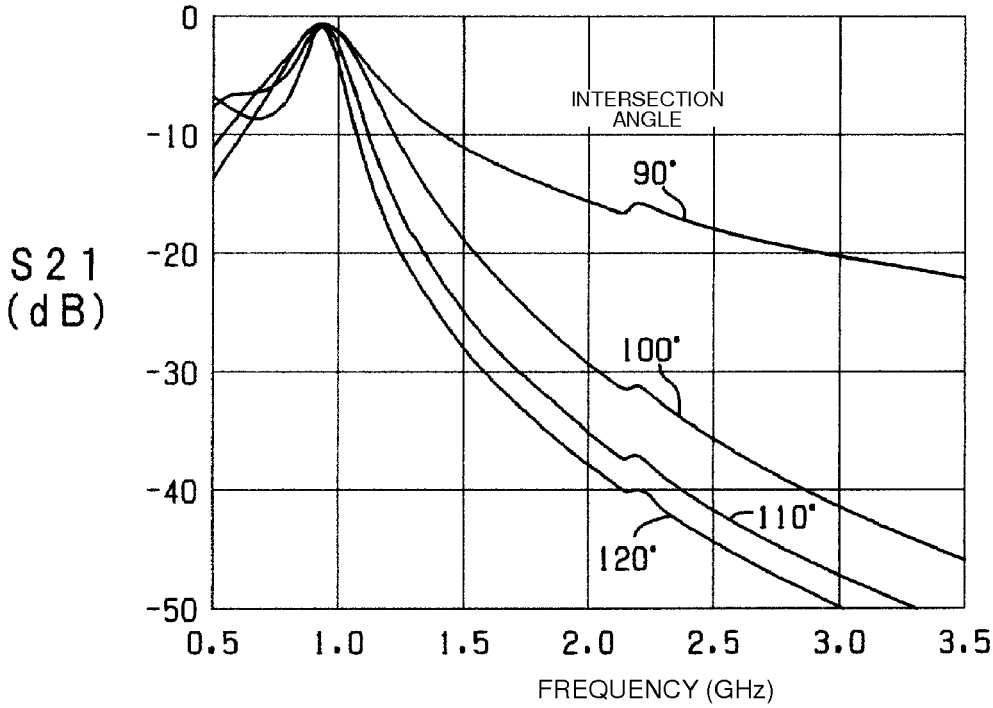
FIG. 16 is a graph showing attenuation characteristics.

Table 4 and FIG. 16 indicate that, by setting the intersection angle θ between the center electrodes 21 and 22 to be greater than about 90 degrees, only connection of the low-pass filter including the inductor 28 and the capacitor 29 to the input port P1 eliminates harmonics, such as the second harmonic and the third harmonic. Conversely, in the case of the two-port isolator 320 (in FIG. 21) of the related art in which the intersection angle θ between the center electrodes 21 and 22 is 90 degrees, in order to eliminate harmonics, a π-LC filter including one series inductor and two parallel capacitors must be connected to the input port P1. As compared to the two-port isolator 320, the size and cost of the two-port isolator 1C according to the fourth preferred embodiment are greatly reduced. In addition, the number of connecting points between elements is reduced, such that the reliability of the two-port isolator 1C is improved.

Figure 17:
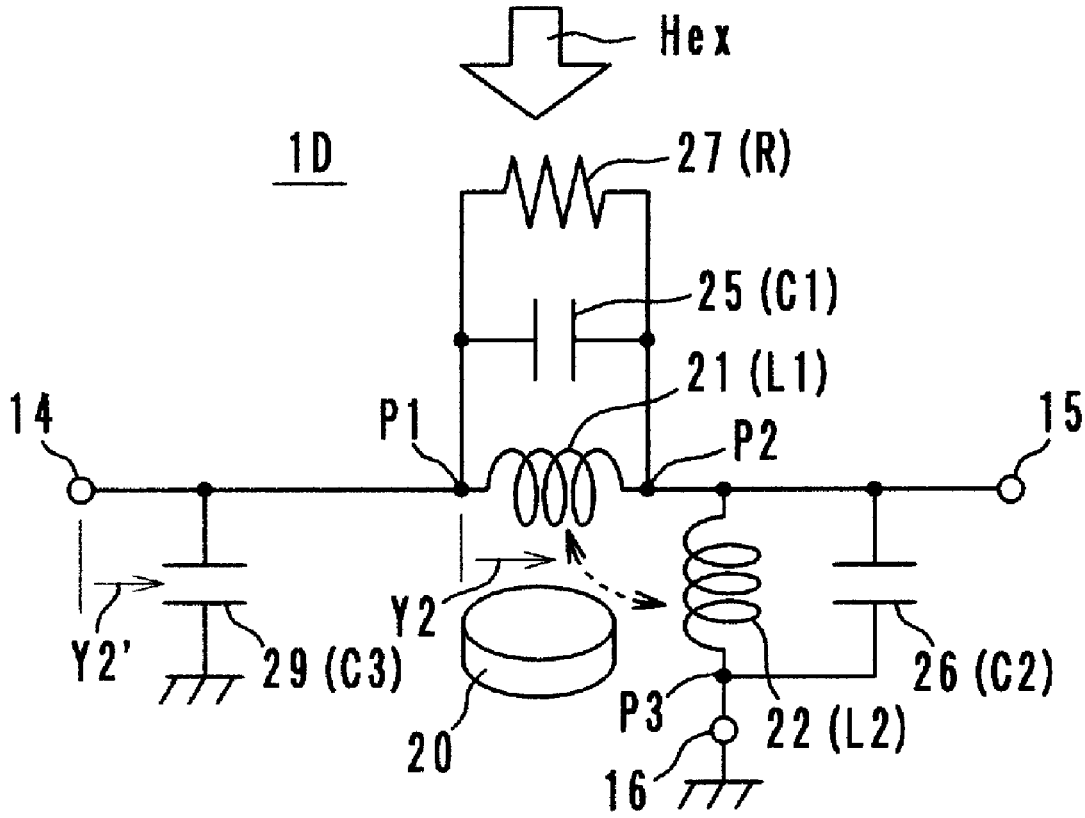
FIG. 17 is an equivalent electrical circuit diagram showing a two-port isolator according to still another preferred embodiment of the present invention.
Figure 18:
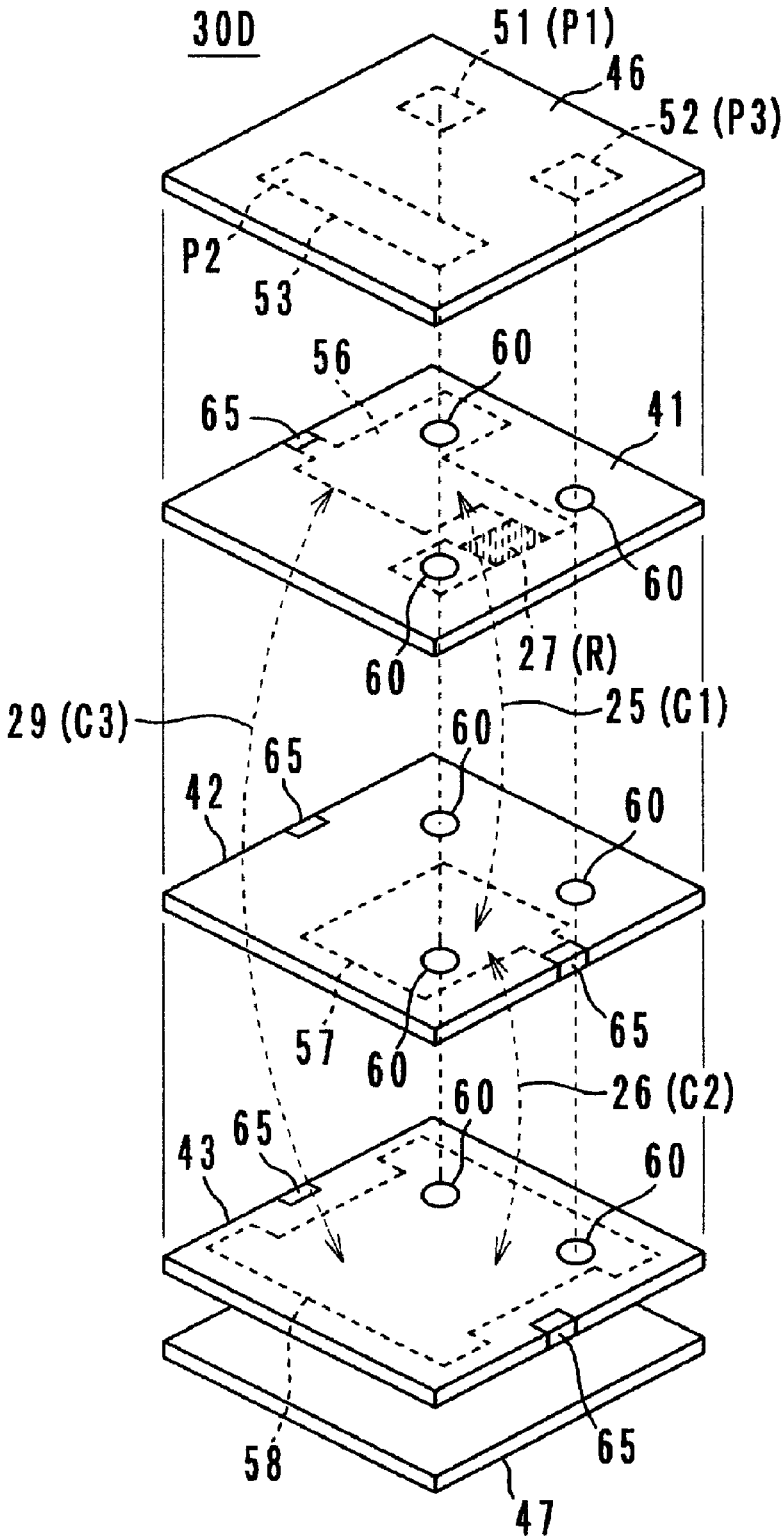
FIG. 18 is an exploded perspective view showing a laminated base of the two-port isolator shown in FIG. 17.

Fifth Preferred Embodiment (FIGS. 17 and 18)

As FIG. 17 shows, a two-port isolator 1D according to a fifth preferred embodiment of the present invention includes a capacitor 29 electrically connected between the input port P1 and the ground. The two-port isolator 1D is configured such that, in the structure shown in FIG. 1, the laminated base 30D shown in FIG. 18 is used instead of the laminated base 30. In the fifth preferred embodiment, the capacitor 29 has a capacitance C3 and is built into the laminated base 30D. However, a chip capacitor may be surface-mounted on the laminated base 30D.

In this case, in order to set the susceptance part of the input admittance Y2' of the input terminal 14 to be approximately zero, the capacitor 29 is set such that the capacitance C3 of the capacitor 29 satisfies the expression:

$$C3=-B/\omega$$

where ω represents an angular frequency, and B represents one of the susceptances in Examples 1 to 3 in Table 1.

The following Table 5 shows values of the capacitance C3 which are determined as described above. The frequency is 926.5 MHz. Since the intersection angle θ is set to be less than about 90 degrees, the susceptance part of the admittance Y2 of the input port P1 is negative in the pass-band center frequency.

TABLE 5

| | L1 [nH] | L2 [nH] | θ [°] | C1 [pF] | C2 [pF] | C3 [pF] | R [Ω] |
|---|---|---|---|---|---|---|---|
| Example 16 | 0.7 | 0.7 | 60 | 15.6 | 15.6 | 11.5 | 60 |
| Example 17 | 0.7 | 0.7 | 70 | 17.2 | 17.2 | 7.0 | 60 |
| Example 18 | 0.7 | 0.7 | 80 | 19.5 | 19.5 | 3.3 | 60 |

Table 5 indicates that the total capacitance of the capacitances C1, C2, and C3 in Examples 16 to 18 is reduced as compared to the total capacitance (see the Related Art in Table 1) of the two-port isolator of the related art. Therefore, by setting the intersection angle θ between the center electrodes 21 and 22 to be less than about 90 degrees, and connecting the capacitor 29 in parallel to the input port P1, the total capacitance is reduced as compared to that of the two-port isolator of the related art, such that the size of the two-port isolator 1D is reduced.

Figure 19:
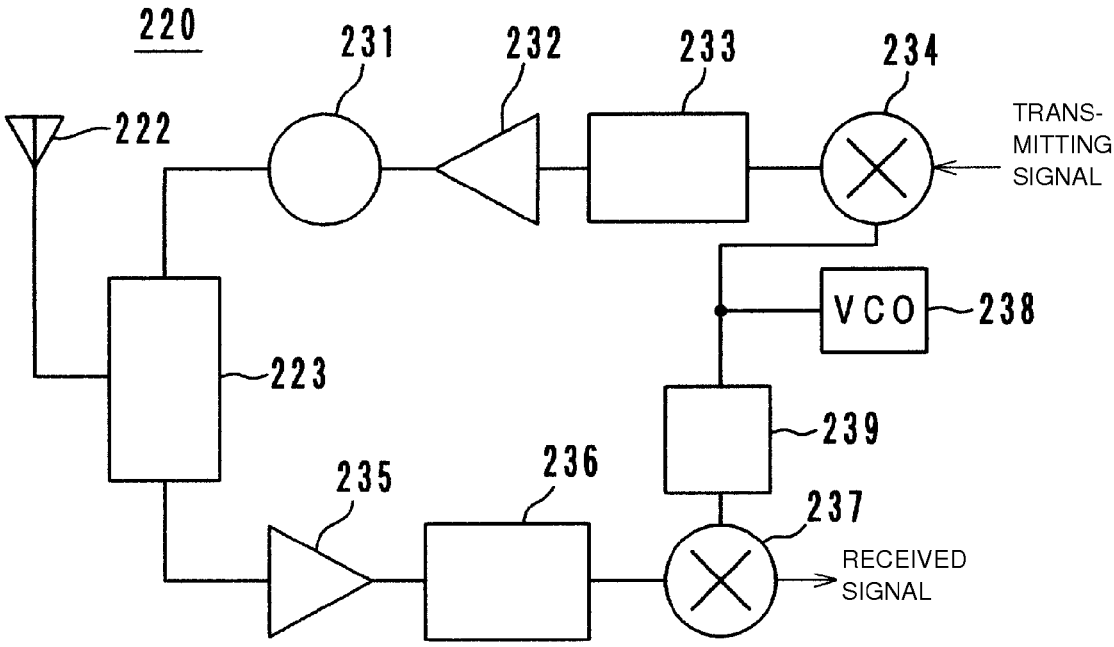
FIG. 19 is an electrical circuit block diagram showing a communication apparatus according to a preferred embodiment of the present invention.

Sixth Preferred Embodiment (FIG. 19)

A communication apparatus according to a sixth preferred embodiment of the present invention is described below, with a cellular phone as an example of the communication apparatus.

FIG. 19 is a circuit block diagram of a radio frequency (RF) portion of a cellular phone 220. The RF portion includes an antenna element 222, a duplexer 223, a transmitting isolator 231, a transmitting amplifier 232, a transmitting interstage band-pass filter 233, a transmitting mixer 234, a receiving amplifier 235, a receiving interstage band-pass filter 236, a receiving mixer 237, a voltage-controlled oscillator (VCO) 238, and a local band-pass filter 239.

Each of the two-port isolators 1, 1A, 1B, 1C, and 1D according to the first to fifth preferred embodiments can be used as the transmitting isolator 231. By mounting each of these two-port isolators, a cellular phone having improved electrical characteristics and high reliability is achieved.

Other Preferred Embodiments

The present invention is not limited to the foregoing preferred embodiments, but may be variously modified. For example, by inverting the N pole and S pole of the permanent magnet 9, the input port P1 and the output port P2 are switched. However, when using the port P2 as an input port, and the port P1 as an output port, an input return loss has a relatively narrow band and an output return loss has a relatively wide band.

It should be understood that the foregoing description is only illustrative of the present invention. Various alternatives and modifications can be devised by those skilled in the art without departing from the present invention. Accordingly, the present invention is intended to embrace all such alternatives, modifications and variations that fall within the scope of the appended claims.

What is claimed is:

1. A two-port isolator comprising:

a permanent magnet;

a ferrite member to which a direct-current magnetic field is applied by said permanent magnet;

a first center electrode having one end electrically connected to a first input/output port and the other end electrically connected to a second input/output port, said first center electrode being provided on said ferrite member;

a second center electrode having one end electrically connected to the second input/output port and the other end electrically connected to a ground port, said second center electrode being arranged on said ferrite member so as to intersect with said first center electrode, with said first center electrode and said second center electrode being electrically insulated from each other;

a first matching capacitor electrically connected between the first input/output port and the second input/output port;

a resistor electrically connected between the first input/output port and the second input/output port;

a second matching capacitor electrically connected between the second input/output port and the ground port;

a first input/output terminal electrically connected to the first input/output port;

a second input/output terminal electrically connected to the second input/output port; and an inductor electrically connected in series between the first input/output port and said first input/output terminal; wherein one of the first input/output port and the second input/output port defines an input port, and the other of the first input/output port and the second input/output port defines an output port; and an intersection angle between said first center electrode and said second center electrode is less than about 90 degrees so as to set a susceptance part of an admittance of the first input/output port to a negative value in a pass-band center frequency.

2. The two-port isolator according to claim 1, wherein the admittance of the first input/output port has a complex conjugate relationship with an external circuit.

3. A communication apparatus including the two-port isolator according to claim 1.

4. A two-port isolator comprising:

a permanent magnet;

a ferrite member to which a direct-current magnetic field is applied by said permanent magnet;

a first center electrode having one end electrically connected to a first input/output port and the other end electrically connected to a second input/output port, said first center electrode being provided on said ferrite member;

a second center electrode having one end electrically connected to the second input/output port and the other end electrically connected to a ground port, said second center electrode being arranged on said ferrite member so as to intersect with said first center electrode, with said first center electrode and said second center electrode being electrically insulated from each other;

a first matching capacitor electrically connected between the first input/output port and the second input/output port;

a resistor electrically connected between the first input/output port and the second input/output port;

a second matching capacitor electrically connected between the second input/output port and the ground port;

a first input/output terminal electrically connected to the first input/output port;

a second input/output terminal electrically connected to the second input/output port; and an inductor electrically connected in series between the first input/output port and said first input/output terminal; wherein one of the first input/output port and the second input/output port defines an input port, and the other of the first input/output port and the second input/output port defines an output port; and an intersection angle between said first center electrode and said second center electrode is greater than about 90 degrees so as to set a susceptance part of an admittance of the first input/output port to a positive value in a pass-band center frequency.

5. The two-port isolator according to claim 4, wherein the admittance of the first input/output port has a complex conjugate relationship with an external circuit.

6. A communication apparatus including the two-port isolator according to claim 4.

7. A two-port isolator comprising:

a permanent magnet;

a ferrite member to which a direct-current magnetic field is applied by said permanent magnet;

a first center electrode having one end electrically connected to a first input/output port and the other end electrically connected to a second input/output port, said first center electrode being provided on said ferrite member;

a second center electrode having one end electrically connected to the second input/output port and the other end electrically connected to a ground port, said second center electrode being arranged on said ferrite member so as to intersect with said first center electrode, with said first center electrode and said second center electrode being electrically insulated from each other;

a first matching capacitor electrically connected between the first input/output port and the second input/output port;

a resistor electrically connected between the first input/output port and the second input/output port;

a second matching capacitor electrically connected between the second input/output port and the ground port; and an inductor electrically connected in series between the first input/output port and said first input/output terminal; wherein one of the first input/output port and the second input/output port defines an input port, and the other of the first input/output port and the second input/output port defines an output port; and an intersection angle between said first center electrode and said second center electrode is an angle other than about 90 degrees so as to set a susceptance part of an admittance of the first input/output port to one of a positive value in a pass-band center frequency and a negative value in the pass-band center frequency.

8. The two-port isolator according to claim 7, wherein the admittance of the first input/output port has a complex conjugate relationship with an external circuit.

9. A communication apparatus including the two-port isolator according to claim 7.

10. A characteristic adjusting method for a two-port isolator comprising the steps of:

providing a two-port isolator comprising:

a permanent magnet;

a ferrite member to which a direct-current magnetic field is applied by said permanent magnet;

a first center electrode having one end electrically connected to a first input/output port and the other end electrically connected to a second input/output port, said first center electrode being provided on said ferrite member;

a second center electrode having one end electrically connected to the second input/output port and the other end electrically connected to a ground port, said second center electrode being arranged on said ferrite member so as to intersect with said first center electrode, with said first center electrode and said second center electrode being electrically insulated from each other;

a first matching capacitor electrically connected between the first input/output port and the second input/output port;

a resistor electrically connected between the first input/output port and the second input/output port;

a second matching capacitor electrically connected between the second input/output port and the ground port;

a first input/output terminal electrically connected to the first input/output port;

a second input/output terminal electrically connected to the second input/output port; and an inductor electrically connected in series between the first input/output port and said first input/output terminal; wherein one of the first input/output port and the second input/output port defines an input port, and the other of the first input/output port and the second input/output port defines an output port; and changing an intersection angle between said first center electrode and said second center electrode so as to adjust a susceptance part of an admittance of the first input/output port.

* * * * *